US010463554B2

(12) United States Patent
O'Reagan et al.

(10) Patent No.: US 10,463,554 B2
(45) Date of Patent: Nov. 5, 2019

(54) ADJUSTABLE WIDTH USER SUPPORT

(71) Applicant: Span-America Medical Systems, Inc., Greenville, SC (US)

(72) Inventors: James R. O'Reagan, Greer, SC (US); Ryan Poole, Simpsonville, SC (US); Shawn Pauley, Simpsonville, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 221 days.

(21) Appl. No.: 15/457,155

(22) Filed: Mar. 13, 2017

(65) Prior Publication Data

US 2017/0319413 A1 Nov. 9, 2017

Related U.S. Application Data

(60) Provisional application No. 62/333,534, filed on May 9, 2016.

(51) Int. Cl.

| | |
|---|---|
| ***A61G 7/05*** | (2006.01) |
| ***A61G 7/057*** | (2006.01) |
| ***A47C 19/04*** | (2006.01) |
| ***A61G 7/002*** | (2006.01) |

(52) U.S. Cl.

CPC ..... *A61G 7/05769* (2013.01); *A47C 19/045* (2013.01); *A61G 7/002* (2013.01); *A61G 7/0509* (2016.11); *A61G 7/05715* (2013.01); *A61G 7/05776* (2013.01)

(58) Field of Classification Search

CPC ..... A61G 7/05
USPC ..... 5/709, 722, 738
See application file for complete search history.

(56) References Cited

U.S. PATENT DOCUMENTS

| | | | |
|---|---|---|---|
| 4,862,538 | A | 9/1989 | Spann et al. |
| 5,025,519 | A | 6/1991 | Spann et al. |
| 5,252,278 | A | 10/1993 | Spann et al. |
| D355,488 | S | 2/1995 | Hargest et al. |
| 5,509,155 | A | 4/1996 | Zigarac et al. |
| 5,568,660 | A | 10/1996 | Raburn et al. |

(Continued)

OTHER PUBLICATIONS

SPAN PressureGuard APM Owner's Manual (SPAN-AMERICA) Oct. 25, 2014 (Oct. 25, 2014), entire document.

(Continued)

*Primary Examiner* — Fredrick C Conley
(74) *Attorney, Agent, or Firm* — Dority & Manning, P.A.

(57) ABSTRACT

Disclosed are apparatus and methodology for an adjustable width foam mattress which involves the use of modified lateral or side edges of an engineered foam mattress. Such lateral portions include collapsible structures for lateral adjustment of the overall width of the mattress. While different shapes are possible, one exemplary arrangement includes plural elongated octagonally-shaped openings. The long sides of such elongated structures form stops against each other as they fill the void of the opening. The relatively shorter sides of such structures articulate during collapse to accommodate such movement. As a result, and as the long sides fill in voids, the support structure essentially switches uniformly from one density to another, when moved from its expanded to its compressed position. An inflatable/deflatable member may be used to assist with expansion and compression of a lateral support structure.

24 Claims, 10 Drawing Sheets

(56) References Cited

U.S. PATENT DOCUMENTS

| | | | | |
|---|---|---|---|---|
| 5,580,504 | A | 12/1996 | Spann et al. | |
| 5,797,155 | A | 8/1998 | Maier et al. | |
| 5,926,884 | A | 7/1999 | Biggie et al. | |
| 6,324,709 | B1 | 12/2001 | Ikeda et al. | |
| 6,618,880 | B1 * | 9/2003 | Chase | A47C 21/026 5/484 |
| 7,406,729 | B2 | 8/2008 | Hornbach et al. | |
| 7,730,562 | B2 | 6/2010 | Hornbach et al. | |
| 7,886,380 | B2 | 2/2011 | Hornbach et al. | |
| 8,621,690 | B2 | 1/2014 | Hornbach et al. | |
| 2002/0073489 | A1 | 6/2002 | Totton et al. | |
| 2006/0053555 | A1 * | 3/2006 | Poulos | A61G 7/005 5/618 |
| 2007/0271705 | A1 * | 11/2007 | Woolfson | A47C 27/001 5/655.9 |
| 2008/0263763 | A1 | 10/2008 | Butler | |
| 2010/0281618 | A1 | 11/2010 | O'Reagan | |
| 2011/0289691 | A1 | 12/2011 | Lafleche et al. | |
| 2014/0026325 | A1 * | 1/2014 | Guthrie | A47C 27/088 5/709 |
| 2014/0310880 | A1 | 10/2014 | Wyatt et al. | |
| 2015/0128347 | A1 | 5/2015 | Hutchison et al. | |
| 2015/0305513 | A1 | 10/2015 | Tiffany | |
| 2017/0027786 | A1 | 2/2017 | Williams et al. | |

OTHER PUBLICATIONS

PressureGuard Bariatric APM Design Figure, RV#19B, single page (11).

PressureGuard Safety Edge Design Figure, copyright 2006, single page.

PCT International Search Report for PCT International Application No. PCT/US 17/23299, Date of actual completion of the international search: May 23, 2017; Date of mailing of the international search report: dated Jun. 16, 2017 (2 pages).

PCT Written Opinion of the International Searching Authority for PCT International Application No. PCT/US 17/23299, Date of completion of the opinion: May 23, 2017, dated Jun. 16, 2017 (6 pages).

* cited by examiner

ADJUSTABLE WIDTH USER SUPPORT

PRIORITY CLAIM

This application claims the benefit of previously filed U.S. Provisional Patent Application entitled "ADJUSTABLE WIDTH FOAM MATTRESS," assigned U.S. Ser. No. 62/333,534, filed May 9, 2016, and which is incorporated herein by reference for all purposes.

FIELD OF THE DISCLOSURE

This subject matter generally relates to mattresses and patient supports for preventing, reducing, and/or treating decubitus ulcers, also known as pressure sores or bedsores, and/or for improved comfort of consumer users. More particularly, the presently disclosed subject matter concerns mattresses or patient supports capable of adjustment of the width of a mattress related to support of a medical patient or consumer user.

BACKGROUND OF THE DISCLOSURE

Often, patients that are bedridden or immobile can develop decubitus ulcers (pressure sores or bedsores). Such ulcers are often caused by pressure, friction, shear forces, moisture, and/or heat. Pressure results in a reduction of blood flow to the soft tissues of the body, particularly the skin. Continuous lack of blood flow, and the resultant lack of oxygen, can cause the skin to die or atrophy, and cause ulcers or sores to form. Friction and shear of the skin against the support surface can lead to skin tears and decubitus ulcers. Moisture and heat may lead to skin maceration. Other factors play a part in determining the speed with which such ulcers will either tend to form or heal, including such as the overall health of the patient and such patient's nutritional status.

From a consumer user perspective (i.e., not necessarily involving long periods of bed rest beyond normal nighttime sleeping), moisture and heat buildup and other factors can create discomfort for the user.

To insure normal (or, at least, relatively improved) blood flow to such areas of potentially problematic contact, patients or consumers may make use of specially outfitted mattresses. One aspect of such mattresses is that they may not be adjustable in terms of width of the supporting surface, which may tend to limit their use.

Some supporting devices make use of static supports such as foam, air or water mattresses, while others involve the use of alternating pressure inflatable features. Examples of support surfaces are illustrated in U.S. Pat. Nos. 5,509,155; 5,926,884; 6,324,709; 7,406,729; 7,730,562; 7,886,380; and 8,621,690. Other examples of various arrangements as may be used are discussed in commonly owned U.S. Pat. Nos. 4,862,538; 5,025,519; 5,252,278; and 5,580,504. The disclosures of all of the foregoing U.S. patents are fully incorporated herein by reference, for all purposes.

While various implementations of therapeutic mattresses or mattress coverlets have been developed, no design has emerged that generally encompasses all of the desired characteristics as hereafter presented in accordance with the subject technology.

SUMMARY OF THE DISCLOSURE

In view of the recognized features encountered in the prior art and addressed by the presently disclosed subject matter, improved apparatus and methodology for adjusting the width of therapeutic mattresses, or of consumer-oriented products, are provided.

Disclosed are apparatus and methodology for an adjustable width foam mattress which involves the use of modified lateral or side edges of an engineered foam mattress. Such lateral portions include collapsible structures for lateral adjustment of the overall width of the mattress. With different shapes possible, an exemplary arrangement includes plural elongated octagonally-shaped openings. The long sides of such elongated structures form stops against each other as they fill the void of the opening. The relatively shorter sides of such structures articulate during collapse to accommodate such movement. As a result, and as the long sides fill in voids, the support structure essentially switches uniformly from one density to another, when moved from its expanded to its compressed position.

In further exemplary embodiments, an inflatable/deflatable member may be used to assist with expansion and compression of a lateral support structure.

It is to be further understood that the adjustable width features herewith may be incorporated into a mattress system comprised of foam, different pieces of foam, combinations of foam and/or air chambers, or other support features such as gel or padding or ticking of any kind.

One exemplary embodiment of the presently disclosed subject matter relates to an adjustable width user support, comprising a central core support section; a pair of side bolsters respectively laterally spaced from such core support section; and respective first and second side foam elements, respectively interconnecting such pair of side bolsters with such central core support section. Preferably, such side foam elements include collapsible structures for lateral adjustment of the overall width of the user support between compressed and expanded positions thereof.

In some such embodiments, such central core support section may form at least part of a patient support mattress; and such collapsible structures may comprise a plurality of elongated openings formed in such foam elements for lateral adjustment of the overall width of the mattress between compressed and expanded positions thereof, with at least some of such openings being formed by elongated structures of respective pairs of relatively longer sides and interconnecting respective relatively shorter sides. In other variations of such an adjustable width user support, when such side foam elements are being moved into such compressed position thereof, such relatively longer sides of such elongated structures may form stops against each other as they fill the void of their respective opening, and such relatively shorter sides of such elongated structures may articulate during collapse to accommodate such relatively longer side movement. Further, such first and second side foam elements may switch uniformly from one density to another when being moved between such expanded and compressed positions thereof.

In yet other variations, such an adjustable width user support may further comprise respective inflatable/deflatable members associated with each of such respective first and second side foam elements, to controllably assist with expansion and compression thereof.

In other present alternatives, such central core support section may further include at least one of different pieces of foam, and combinations of foam and supporting air chambers. For others, such central core support section may further include respective ends which combine with such pair of side bolsters to form a cavity of such user support; and a plurality of support foam sections received within such cavity; and such user support may further include a waterproof, vapor impermeable, removable cover around such central core support section, such pair of side bolsters, and such side foam elements.

Per some variations of a presently disclosed adjustable width user support, such user support may comprise one of a therapeutic mattress, a wheelchair support, a seating cushion, a patient positioner, and a consumer mattress, and such pair of side bolsters may comprise a relatively firm perimeter of foam for patient support.

In yet another exemplary embodiment of presently disclosed subject matter, an adjustable width patient support system may comprise an adjustable bed frame and an adjustable width mattress. Such adjustable bed frame preferably may be adjustable between a laterally compressed position and a laterally expanded position thereof. Such adjustable width mattress preferably may have lateral adjustment of the overall width of the mattress between compressed and expanded positions thereof, matching the laterally compressed position and laterally expanded position, respectively, of such adjustable bed frame. Further, such mattress may preferably comprise a central core support section including at least one section of support foam; a pair of foam side bolsters respectively laterally spaced from such central core support section; and respective first and second side foam elements. Such respective first and second side foam elements preferably respectively interconnect such pair of side bolsters with such central core support section, with such side foam elements preferably including collapsible structures comprising a plurality of elongated openings formed in such foam elements for lateral adjustment of the overall width of the mattress between compressed and expanded positions thereof.

In variations of the foregoing, such elongated openings may comprise octagonally-shaped openings, with at least some of such openings being formed by elongated structures of respective pairs of relatively longer sides and interconnecting respective relatively shorter sides.

In yet other variations, when such mattress is being moved into such compressed position thereof by such adjustable bed frame, such relatively longer sides of such elongated structures may form stops against each other as they fill the void of their respective opening, and such relatively shorter sides of such elongated structures may articulate during collapse to accommodate such relatively longer side movement. Further, in such variations, such first and second side foam elements may switch uniformly from one density to another, when such mattress is moved between such expanded and compressed positions thereof. In another presently disclosed exemplary alternative, in some instances, such patient support system may further comprises respective inflatable/deflatable members associated with each of such respective first and second side elements, to controllably assist with expansion and compression thereof.

Per yet further exemplary alternatives, such central core support section may further include at least one of different pieces of foam, combinations of foam and supporting air chambers, gel support elements, and mattress padding.

In another variation of presently disclosed exemplary adjustable width patient support system subject matter, such central core support section may further include respective ends which combine with such pair of foam side bolsters to form a cavity of such mattress; and a plurality of support foam sections received within such mattress cavity. For some such variations, the orientation and support characteristics of such support foam sections may be preselected for predetermined patient support, and such pair of side bolsters may comprise a relatively firm perimeter of foam for patient support.

In yet other presently disclosed alternatives, an adjustable width patient support system as presently disclosed may in some instances further comprise a waterproof, vapor impermeable, removable cover around such mattress; and such mattress may be at least about 4 inches thick, about 80 inches long, and at least about 35 inches wide in at least one position thereof. For some variations herewith, such plurality of elongated openings may be formed along the entire length of such foam elements. For yet others, at least some of such elongated openings may be partially interrupted by the width of such foam elements, so that at least some only partial elongated openings are present.

In yet other presently disclosed variations, such central core support section may further include a plurality of supporting air chambers, and such system may further include associated air tubing and a controllable air pump, for selectively inflating or deflating such supporting air chambers. For others, a presently disclosed adjustable width patient support system may in some instances further include a three-dimensional fabric portion selectively positioned above at least a portion of such central core support section, and associated controllable air flow elements operative with such three-dimensional fabric portion for selectively circulating air in the vicinity of a patient received on such mattress, for removing heat and moisture from such patient.

Those of ordinary skill in the art will appreciate from the complete disclosure herewith that some embodiments of presently disclosed subject matter may relate to corresponding and/or associated methodology. In yet another exemplary embodiment of presently disclosed subject matter, for example, methodology may be practiced for providing an adjustable width patient support system, comprising providing a bed frame which is controllably adjustable between a laterally compressed position and a laterally expanded position thereof; and providing on such bed frame an adjustable width mattress having lateral adjustment of the overall width of the mattress between compressed and expanded positions thereof, matching the laterally compressed position and laterally expanded position, respectively, of the adjustable bed frame. Per such exemplary embodiment, such mattress may preferably comprise a central core support section; a pair of side bolsters respectively laterally spaced from such central core support section; and respective first and second side foam elements, respectively interconnecting such pair of side bolsters with such central core support section, such side foam elements preferably including collapsible structures comprising a plurality of elongated openings formed in such foam elements, with at least some of such openings being formed by elongated structures of respective pairs of relatively longer sides and interconnecting respective relatively shorter sides. Per such structure and methodology, when the mattress is being moved into its compressed position by the adjustable bed frame, such relatively longer sides of such elongated structures preferably form stops against each other as they fill the void of their respective opening, and such relatively shorter sides of such elongated structures preferably articulate during collapse to accommodate such relatively longer side movement.

Variations of such presently disclosed methodology may further include providing respective inflatable/deflatable members associated with each of such respective first and second side foam elements; and controllably operating inflation and deflation of such inflatable/deflatable members to assist with expansion and compression. Other variations may further include forming such central core support section with at least one of different pieces of foam, combinations of foam and supporting air chambers, gel support elements, and mattress padding.

In other present alternatives of the foregoing, such methodology may in some instances further include forming such central core support section with respective ends positioned relative to such pair of side bolsters to form a cavity of such mattress; and providing a plurality of support foam sections within such mattress cavity, and providing such pair of side bolsters as a relatively firm perimeter of foam for patient support. For others, presently disclosed methodology may further include forming such plurality of elongated openings along the entire length of such side foam elements; and providing a waterproof, vapor impermeable, removable cover around such mattress.

Additional objects and advantages of the presently disclosed subject matter are set forth in, or will be apparent to those of ordinary skill in the art from, the detailed description herein. Also, it should be further appreciated that modifications and variations to the specifically illustrated, referenced, and/or discussed features, steps, and elements hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
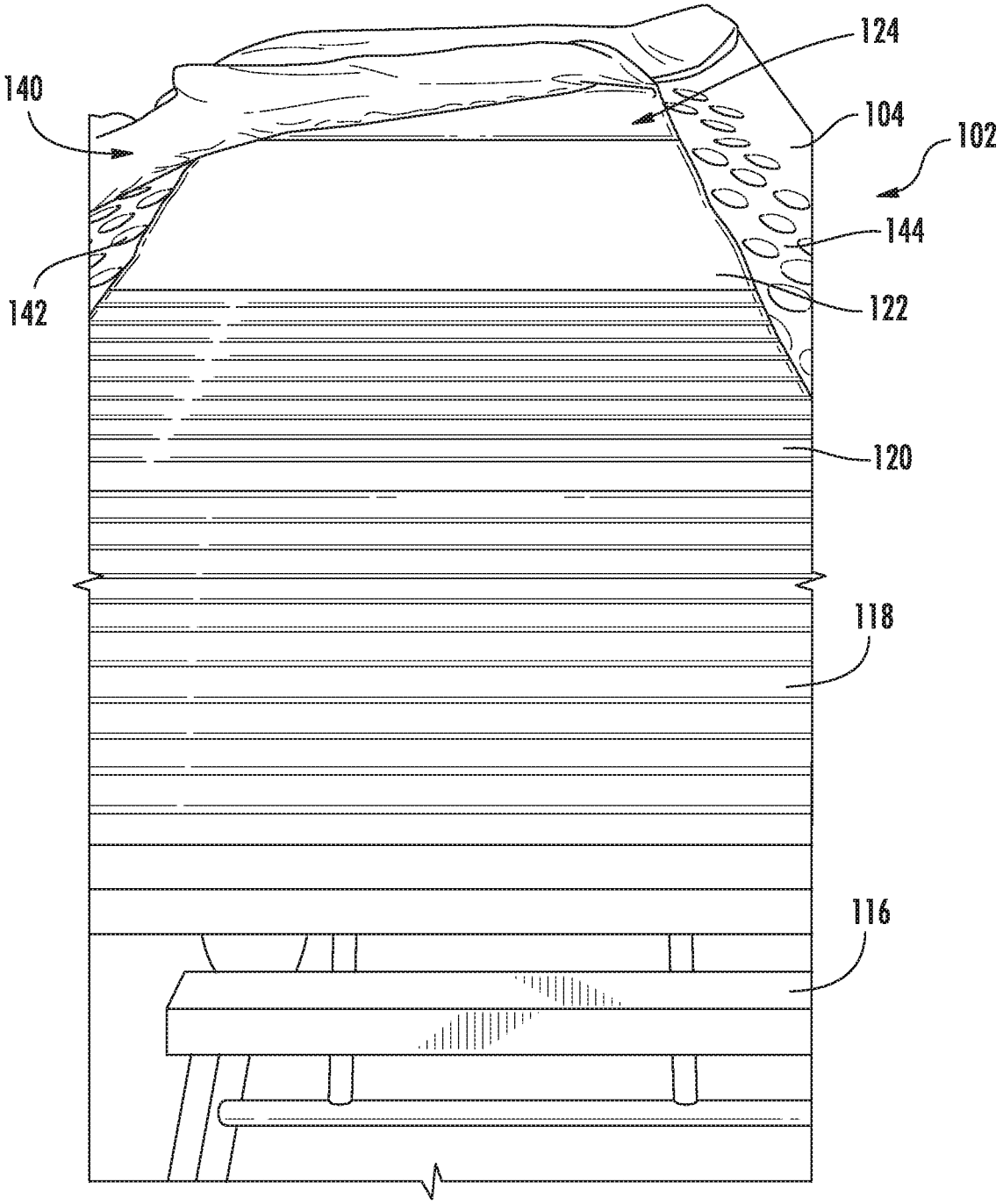
FIG. 1 is a generally top and partial end perspective view of an image of an exemplary embodiment in accordance with presently disclosed subject matter, and partially shown as supported on a mattress or bed carriage, and with a mattress cover portion thereof partially removed for clarity.

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

As discussed in the Summary of the Disclosure section, the presently disclosed subject matter is particularly concerned with apparatus and methodology for controlling the level of moisture and/or heat within a therapeutic mattresses or similar apparatus (or other context, such as wheel chair or other patient or consumer support) provided in accordance with presently disclosed subject matter.

Selected combinations of aspects of the disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of one or more other present embodiment to yield yet further embodiments. Additionally, certain features or steps may be interchanged with similar devices, features or steps not expressly mentioned but which perform the same or similar function.

Figure 2A:
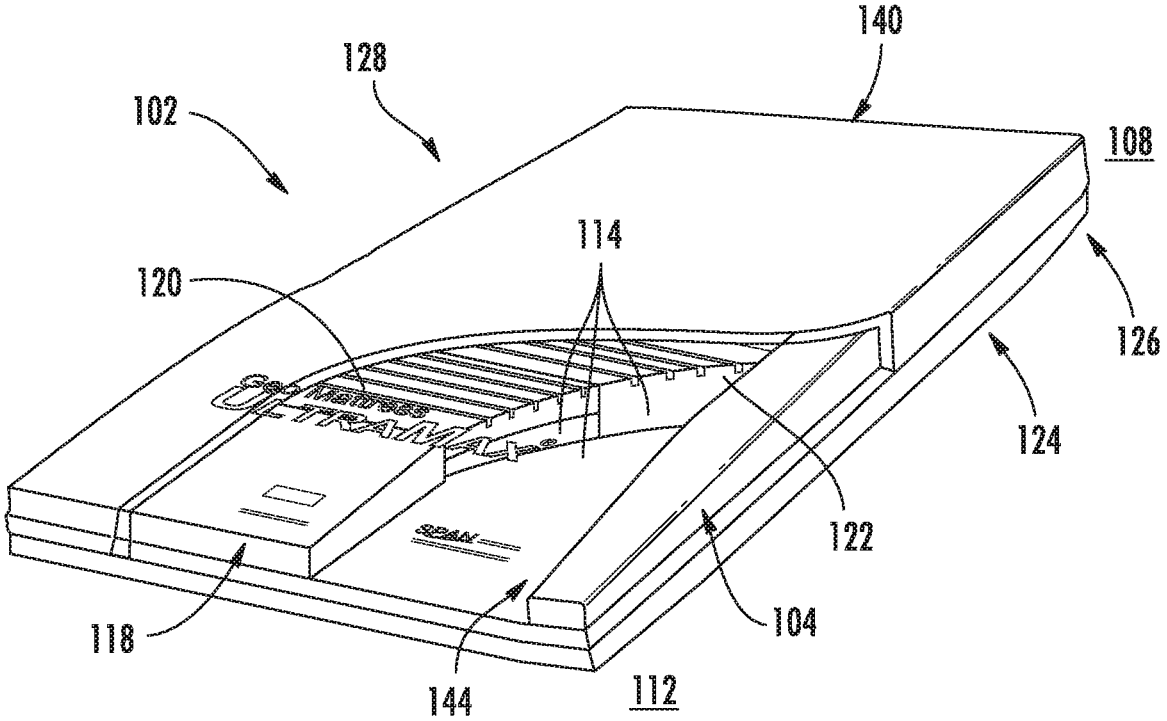
FIG. 2A is a generally side and front perspective view (in partial cutaway) of an exemplary patient support surface with features which may be practiced in combination with presently disclosed subject matter.
Figure 2B:
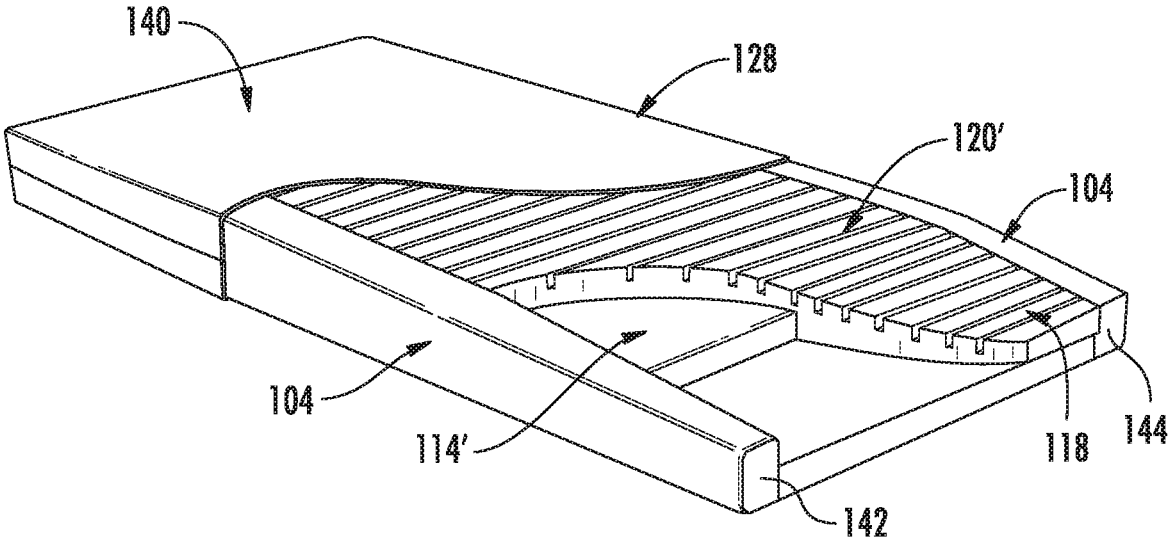
FIG. 2B is a generally side and front perspective view (in partial cutaway) of another exemplary patient support surface with features which may be practiced in combination with presently disclosed subject matter.

Referring collectively to FIGS. 1, 2A, and 2B, a presently disclosed exemplary multi-piece foam mattress system generally 102 has a foam shell portion including foam bolsters/sides 104 running the length of the mattress 102 and on either side thereof. At the respective ends of the foam mattress 102 and capping the foam bolsters/sides 104 may or may not be, respectively, a foam header adjacent head end 108 and foam footer adjacent foot end 112, which along with the bolsters 104 can form a cavity in the mattress 102. Such cavity when used (not numbered) may be configured in this example for positioning of supports such as foam sections 114 therein. As seen from the various present figures, such exemplary selected plurality of foam sections 114 in this exemplary embodiment may run from head to foot, received within such cavity. Other configurations, including different pluralities of foam sections, and/or orientations and/or locations thereof may be practiced in various embodiments, as understood by those of ordinary skill in the art. FIG. 2B represents an exemplary embodiment where a single foam piece 114' is used to cover a larger area covered by multiple separate pieces in FIG. 2A.

As illustrated, mattress 102 may be received on a bed carriage or frame 116. Particularly in a hospital setting, such frame may be adjustable, for example, to change the height of the mattress or the slope or contour of the mattress.

The partial cutaway view of FIG. 2A represents different respective sections or subportions 118, 120, 122, 124, and 126 which may be practiced for specialized support protocols, and may be glued or otherwise joined together to form an upper foam support surface generally 128. For example, such subportions may comprise foams having different support characteristics, or particular support features, such as a grooved surface, as illustrated. Note that sections 124 and 126 are not visible in FIG. 2A, and section 126 is not visible in FIG. 1, but are all under the cover 140 as understood by those of ordinary skill in the art from the complete disclosure herewith. The alternative embodiment of FIG. 2B represents the use of a foot/heel section 118 in combination with otherwise a single upper support surface section 120'.

The represented additional layer or casing/cover 140 may comprise a waterproof, vapor impermeable sheet for protection of the underlying mattress 102. Such additional layer or layers may also additionally comprise a zippered sheath for encasing the mattress 102. Such cover 140 is illustrated in FIGS. 1, 2A, and 2B as partially removed or pulled back to at least partially show support structure thereunder.

FIG. 1 represents generally dimensional relationships in terms of thickness and width of an exemplary mattress 102. For such example, thickness may be about 4.0 inches or higher. In present FIG. 1, the exemplary embodiment may be about 80 inches in length, ±0.75 inches. Per presently disclosed subject matter, the width may be adjustable, with one example being about 35.5 inches±0.5 inches. Those of ordinary skill in the art will appreciate that variations of nearly all dimensions shown or suggested herewith may be practiced to provide or accommodate for specifically desired embodiments, to satisfy different ranges of patient needs, such as pediatric patients or even bariatric patients. All such variations are intended as coming within the spirit and scope of the presently disclosed subject matter, and dimensional examples herewith are presented without limitation on such alternatives.

FIGS. 2A and 2B represent location-wise and FIG. 1 shows in general detail representative side foam elements 142 and 144, respectively residing between side bolsters 104 and lateral edges of the subparts 118-126. Such foam elements 142 and 144 are shown in some greater detail in FIG. 1, and comprise modified lateral or side edges of an engineered foam mattress. Such lateral portions include collapsible structures for lateral adjustment of the overall width of the mattress. An inflatable/deflatable member may be used to assist with expansion and compression of a lateral support structure 142 or 144. Such lateral support structures may optionally be bounded by a further foam piece across the foot end 112 of the mattress 102, or instead members 142 and 144 may extend all the way to an end piece. The more general illustrations of FIGS. 2A and 2B represent the positions of outer side bolsters 104 and those portions 142 and 144 thereof which may be replaced per presently disclosed subject matter with the detailed expandable/compressible features as shown in FIG. 1.

FIGS. 4 through 8 represents the presently disclosed apparatus and methodology for an adjustable width foam mattress which involves the use of modified lateral or side edges 142 and 144 of an engineered foam mattress 102. Such lateral portions 142 and 144 include collapsible structures for lateral adjustment of the overall width of the mattress. An inflatable/deflatable member (representative tube 148) may be used with representative air tubing 150 to assist with expansion and compression of a lateral support structure (see feature 144 of FIG. 4).

With different shapes possible, an exemplary arrangement includes plural elongated octagonally-shaped openings 152. As shown, some such openings are interrupted by the width of the member 142 or 144, so that only partial structures are present. See, for example, structures 154 and 156 which show variations possible in such partial structures. It is to be understood to those of ordinary skill in the art from the complete disclosure herewith and accompanying figures that a plurality of repeating structures 152 and/or structures 154 and 156 encompass the entire length of foam elements 142 and 144.

Figure 4:
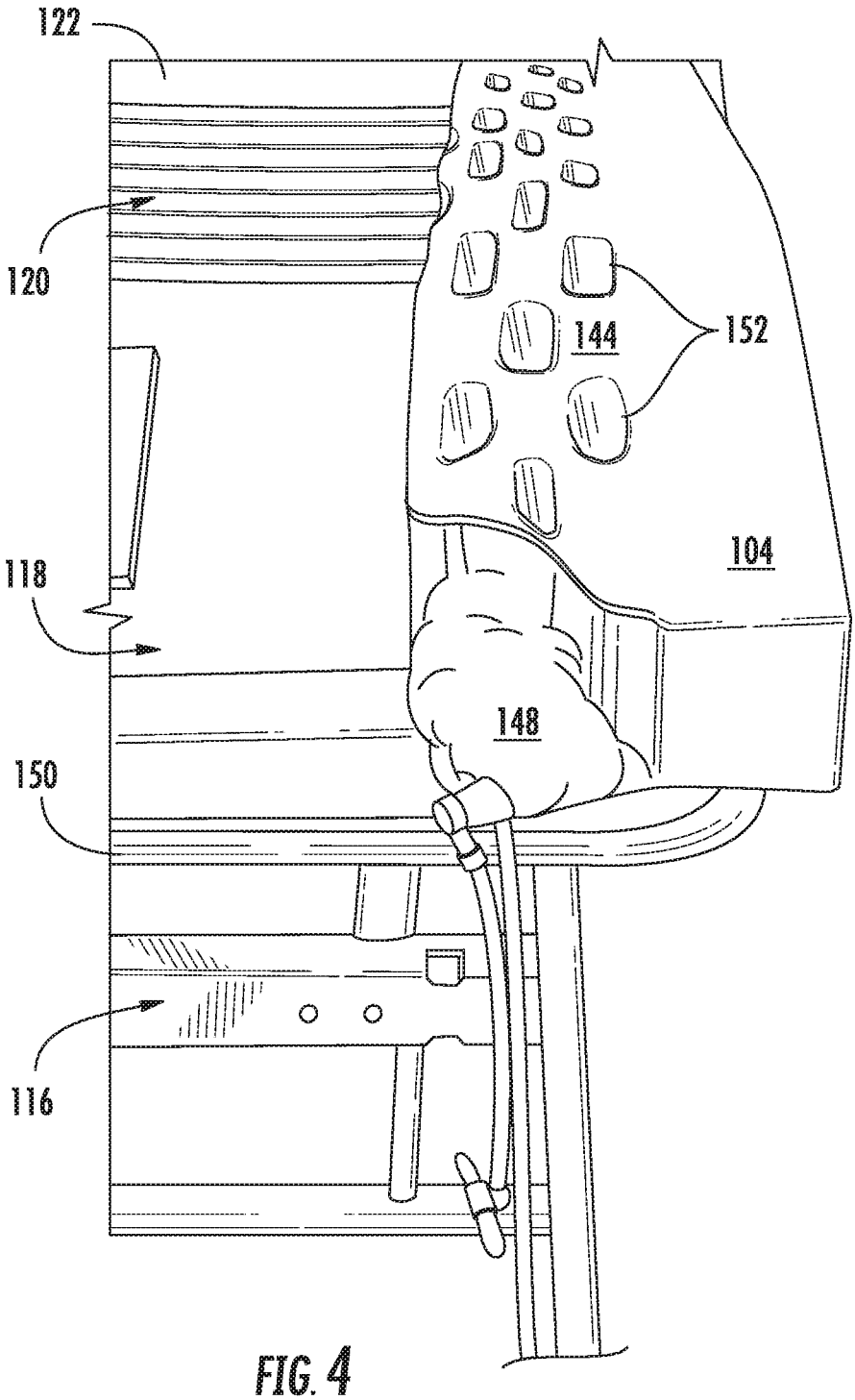
FIG. 4 is a generally enlarged and isolated partial view of the exemplary embodiment of the image of application FIG. 1.
Figure 5:
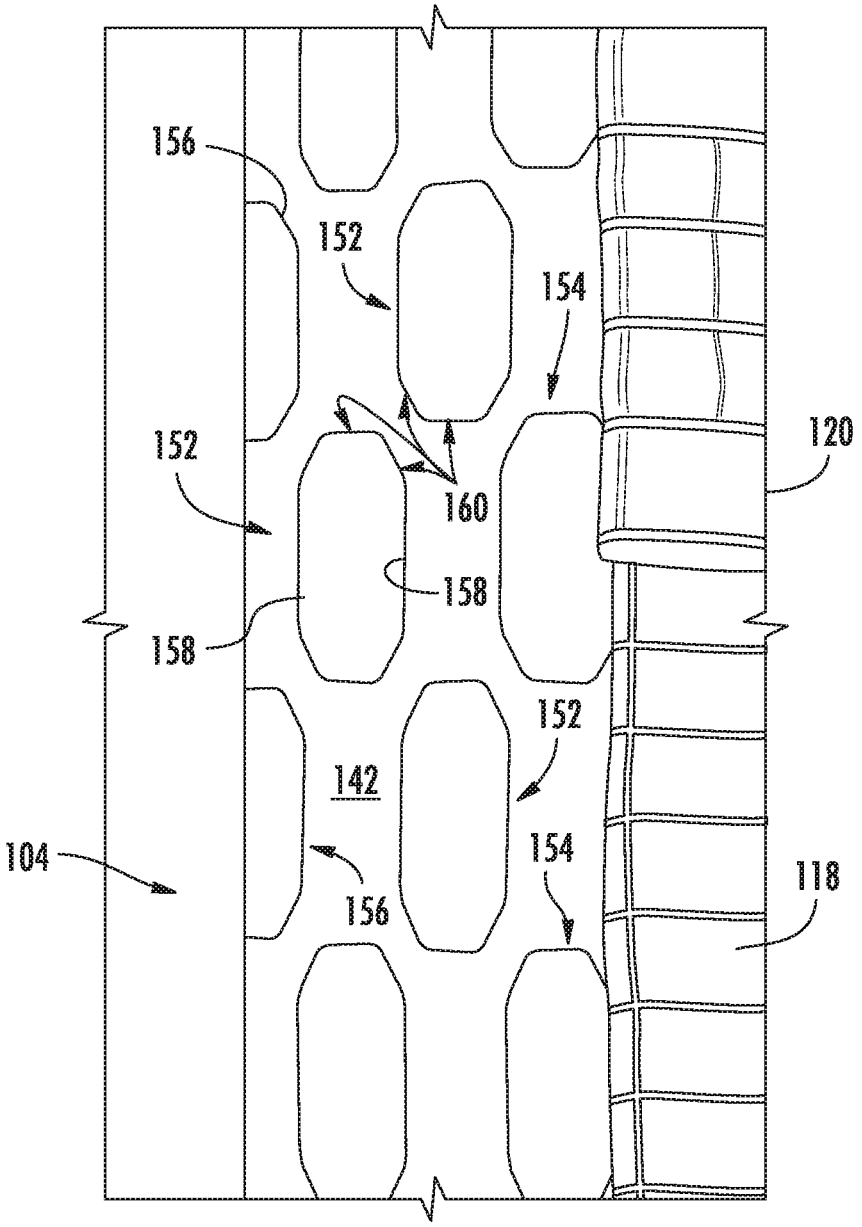
FIG. 5 is a further generally enlarged and isolated partial view (image) of the exemplary embodiment of the image of application FIG. 1, with no compression shown for an adjustable width portion thereof.
Figure 6:
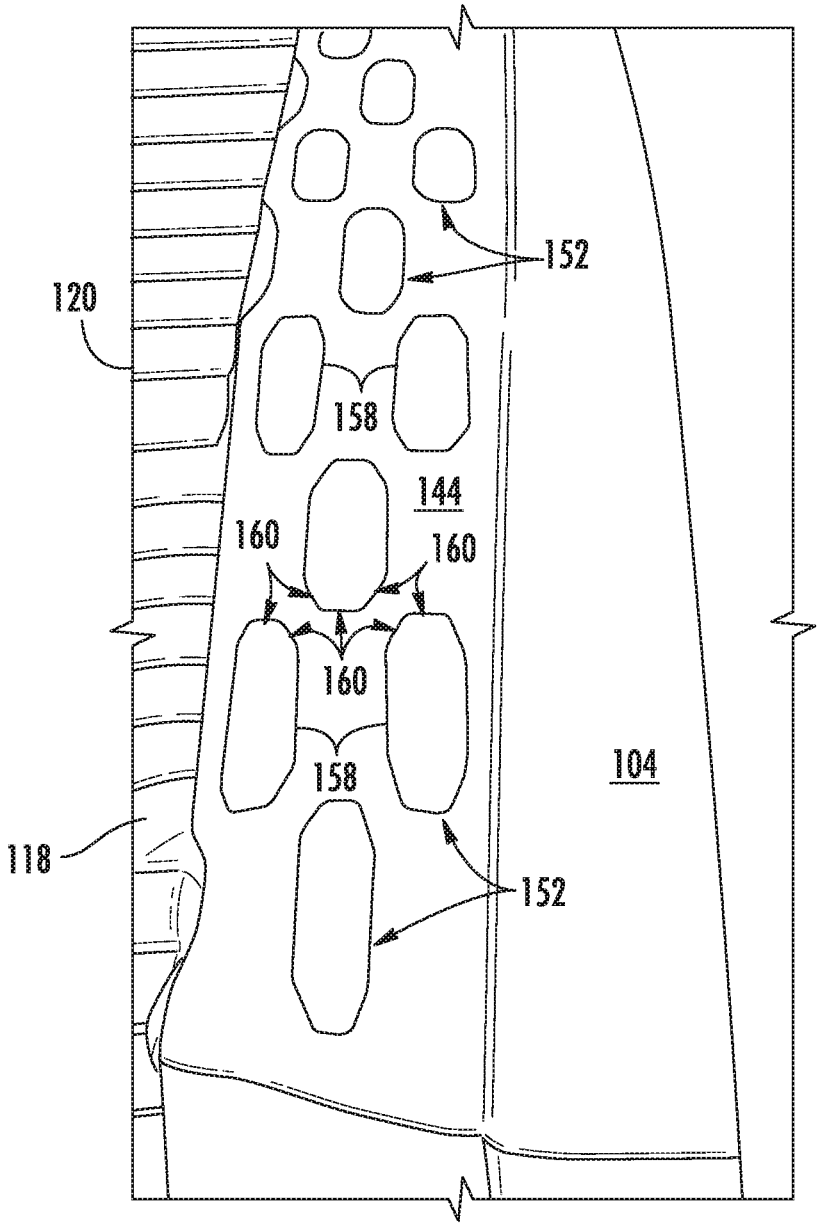
FIG. 6 is another further generally enlarged and isolated partial view (image) of the exemplary embodiment of the image of application FIG. 1, with no compression shown for an adjustable width portion thereof, and with positioning illustrated for an associated inflatable/deflatable member which may be used to assist with expansion and compression of a lateral support structure.
Figure 7:
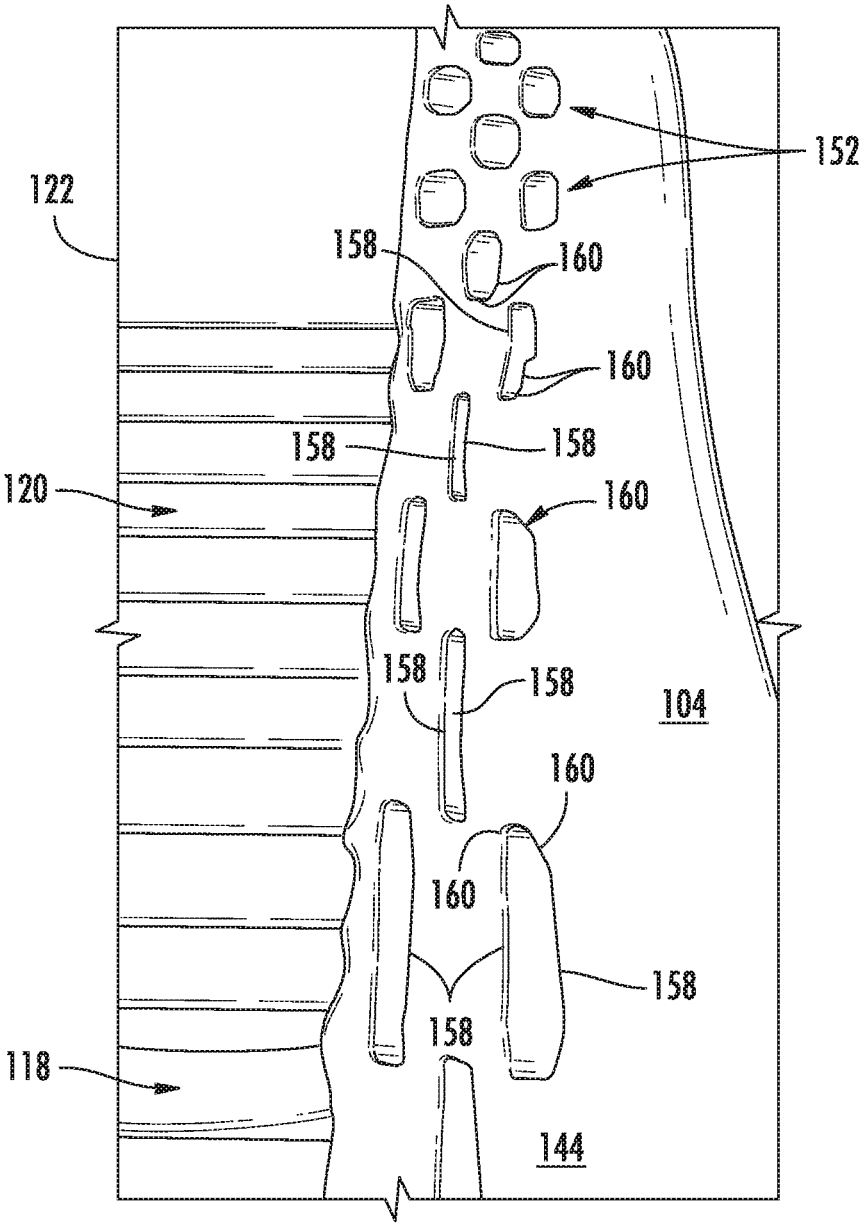
FIG. 7 is another further generally enlarged and isolated partial view (image) similar to that of application FIG. 6, of the exemplary embodiment of the image of application FIG. 1 but with at least partial compression shown for an adjustable width portion thereof.
Figure 8:
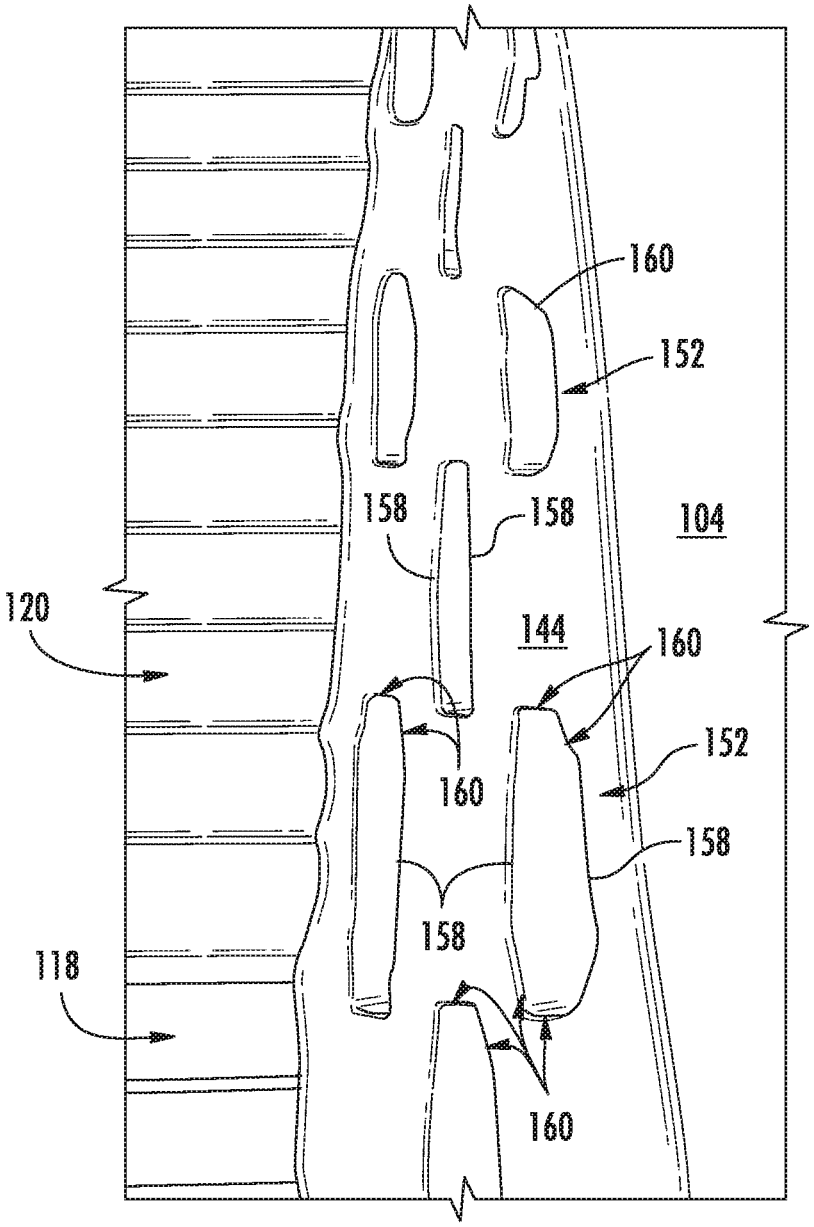
FIG. 8 is another further generally enlarged and isolated partial view (image) similar to that of application FIG. 7, of the exemplary embodiment of the image of application FIG. 1, with at least partial compression shown for an adjustable width portion thereof.

The long sides 158 of such elongated (full) structures 152 form stops against each other as they fill the void of the opening. The relatively shorter sides 160 of such structures articulate during collapse to accommodate such movement. As a result, and as the long sides fill in voids, the support structure essentially switches uniformly from one density to another, when moved from its expanded to its compressed position. When octagonally-shaped openings 152 are practiced, as shown by example, typically there are one pair of such relatively longer sides 158 and three pairs of such relatively shorter sides 160 associated with each fully formed opening 152. FIGS. 4-6 represent such expanded state or position of foam pieces 142 and 144, while FIGS. 7 and 8 represent variously compressed positions. In FIGS. 7 and 8, at least partial compression is represented for an adjustable width portion thereof, by simple manual deflection, for purposes of illustration. During intended use, typically the entire length of the adjustable width mattress would be compressed or expanded, as the case may be.

As shown in such FIGS. 7 and 8, the voids of structures 152 (as well as the partial structures) begin to close as the foam piece 142 or 144 is laterally compressed. A portion of bed frame 116 or some other element may be used to controllably make such lateral compression, in conjunction with removal or exhaustion of air from tubing 148 (when such tubing is used). From such compressed state, air may be reintroduced into tubing 148 via hose or air tubing features 150, to return the structures to their fully expanded state, or at any location or position in between fully expanded and fully compressed, as desired. All such variations are intended to come within the scope of the presently disclosed subject matter.

Figure 3A:
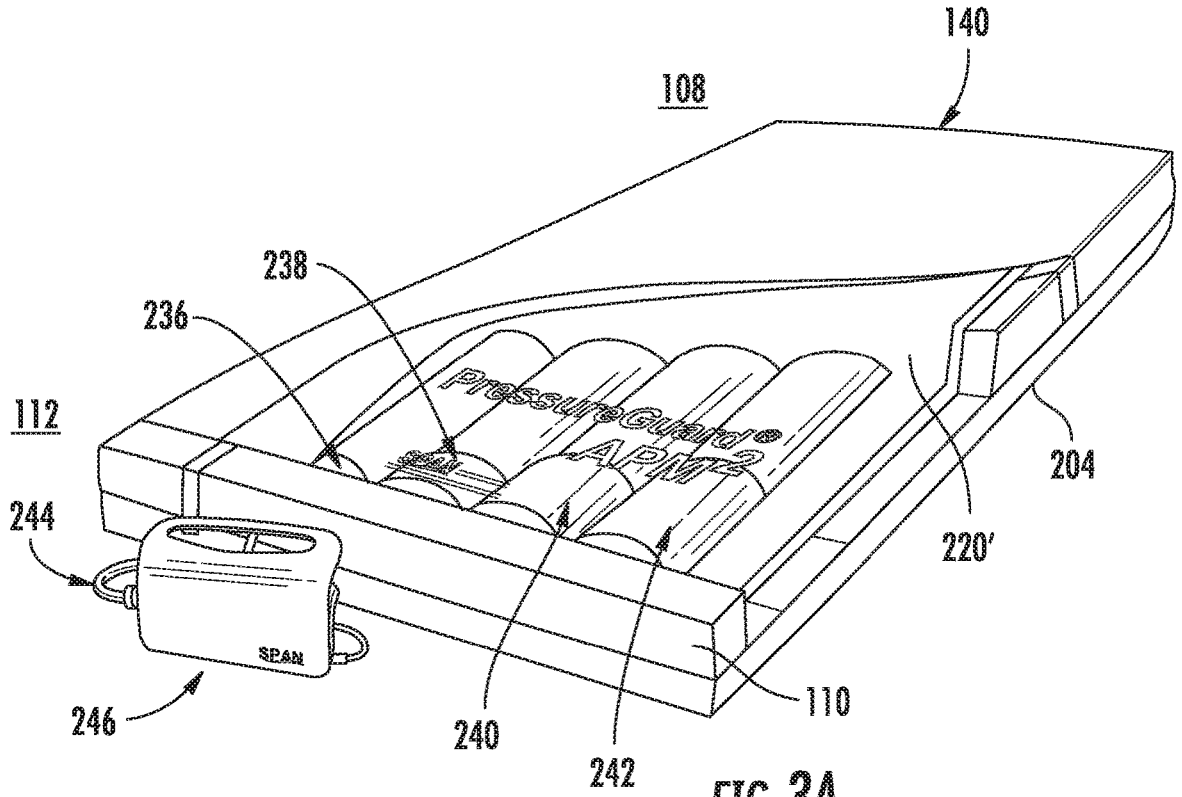
FIG. 3A is a generally side and front perspective view (in partial cutaway) of yet another exemplary patient support surface with features which may be practiced in combination with presently disclosed subject matter.
Figure 3B:
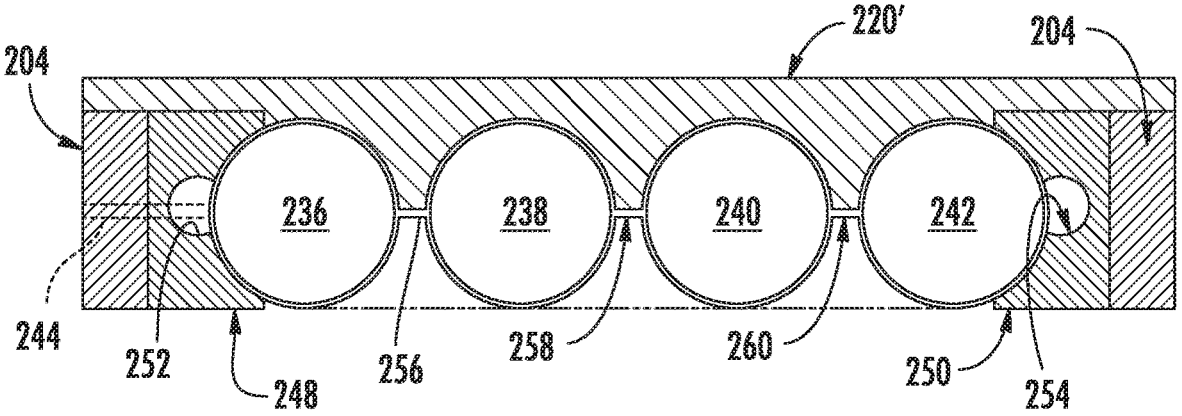
FIG. 3B is a cross-sectional view of the exemplary patient support surface as represented in present FIG. 3A.

As noted above, both embodiments of present FIGS. 2A and 2B are generally foam mattress systems, with FIG. 2A representing multiple upper surface pieces versus the single piece (120') focused system of FIG. 2B, and with FIG. 2A representing multiple underlying support elements 114 versus the single underlying support element 114' of FIG. 2B. FIGS. 3A and 3B represent the optional inclusion of various air support structures.

More specifically, FIG. 3A is a generally side and front perspective view (in partial cutaway) of yet another exemplary patient support surface with air and foam support features which may be practiced in combination with presently disclosed subject matter, and FIG. 3B is a cross-sectional view of such exemplary FIG. 3A embodiment. In general, much of the internal foam support features received in the internal cavity of FIGS. 2A and 2B exemplary embodiments have been replaced by four elongated air support tubes 236, 238, 240, and 242. Respective side bolsters 204 are again replaced in part with the expandable/collapsible features 142 and 144. Representative air tubing 244 may be connected with a controllable air pump 246 for selectively inflating or deflating all are respective ones or groups of such air support tubes 236, 238, 240, and 242.

FIGS. 3A and 3B further represent in the partial cutaway exposure thereof the fact that foam topper 220' thereof may be provided with particular underside features for accommodating and receiving air cylinders. Different numbers and sizes of generally longitudinal air cylinders may be practiced, and laterally-positioned air cylinders may also be practiced with certain variations.

FIGS. 3A and 3B represent the exemplary use of four longitudinal air cylinders 236, 238, 240, and 242. Each such air cylinder has a respective end, at which a connection is made with a respective section of air tubing 244, which interconnects with the interior of the respective air cylinders to facilitate initially establishing the air pressure therein and/or later adjusting such amount of air pressure.

Another aspect of the exemplary prior art embodiment represented in present FIG. 3B is the inclusion of a pair of inner bolsters 248 and 250, which run longitudinally along the lengthwise axis of a patient support surface. As illustrated, each inner bolster 248 and 250 has a respectively inwardly facing concave surface which interacts with part of the curvature of respective air cylinders 236 and 242. Still further, each concave face is provided with at least one respective curved slot 252 and 254, respectively. FIG. 3B further represents additional aspects of the exemplary prior art mattress, with a plurality of depending elements (not marked) which form downwardly facing arches which interact and interface with the generally top sides of the respective air cylinders 236, 238, 240, and 242. Such resulting combination cradles and surrounds the air cylinders, to provide an interlocked, integrated design.

The FIG. 3B cross section also shows the placement relationship among the air cylinders and various exemplary foam components. The locations of a foam topper, perimeter bolster components 204, and inner or side bolsters 248 and 250 are all distinguished by the use of differentiated cross hatching, as will be well understood by those of ordinary skill in the art. A general outward path of an exemplary air tube 244 is represented in dotted line. Wide welds 256, 258, and 260 are created for holding together adjacently respective pairs of air cylinders. In general, the air cylinders are integrally formed so as to be reinforced, fabricated from, for example, high tinsel woven nylon fabric fused to heavy gauge polymeric film.

Figure 9A:
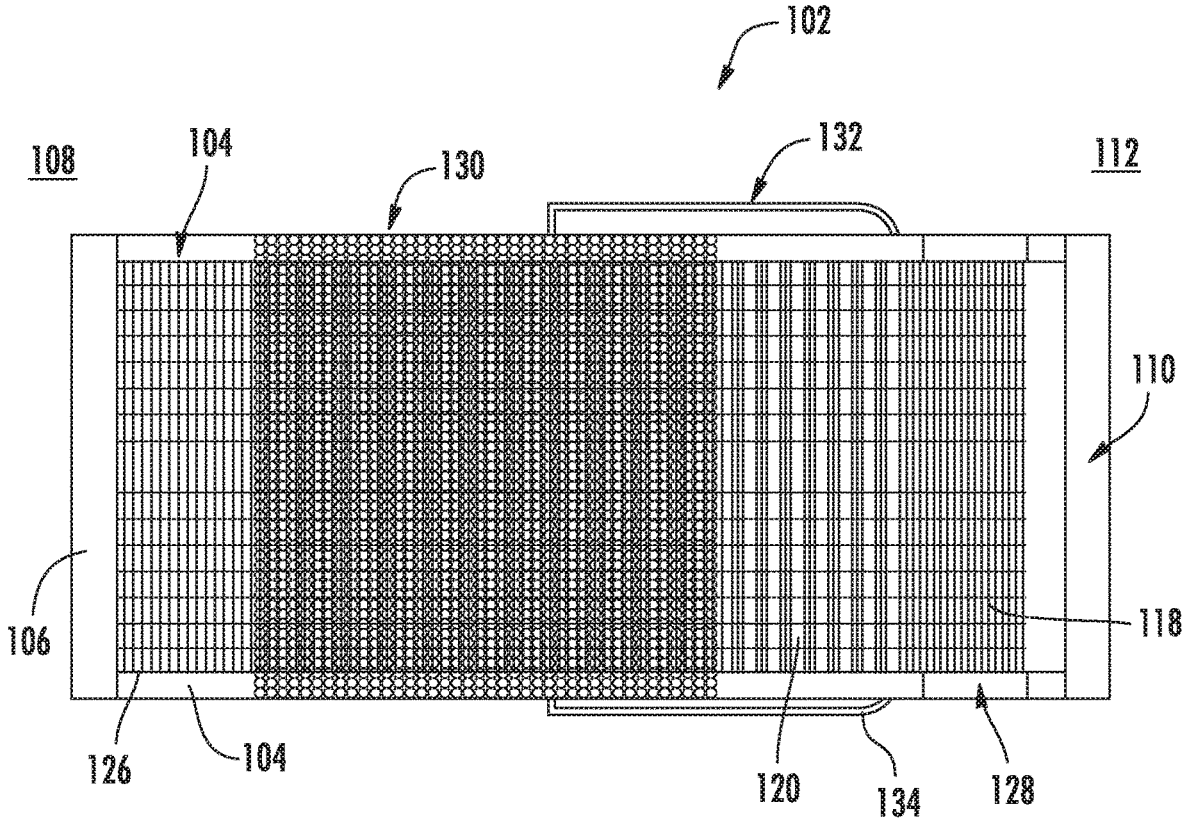
FIG. 9A is a generally top elevational view of certain aspects of a further exemplary patient support surface with features which may be practiced in combination with presently disclosed subject matter.
Figure 9B:
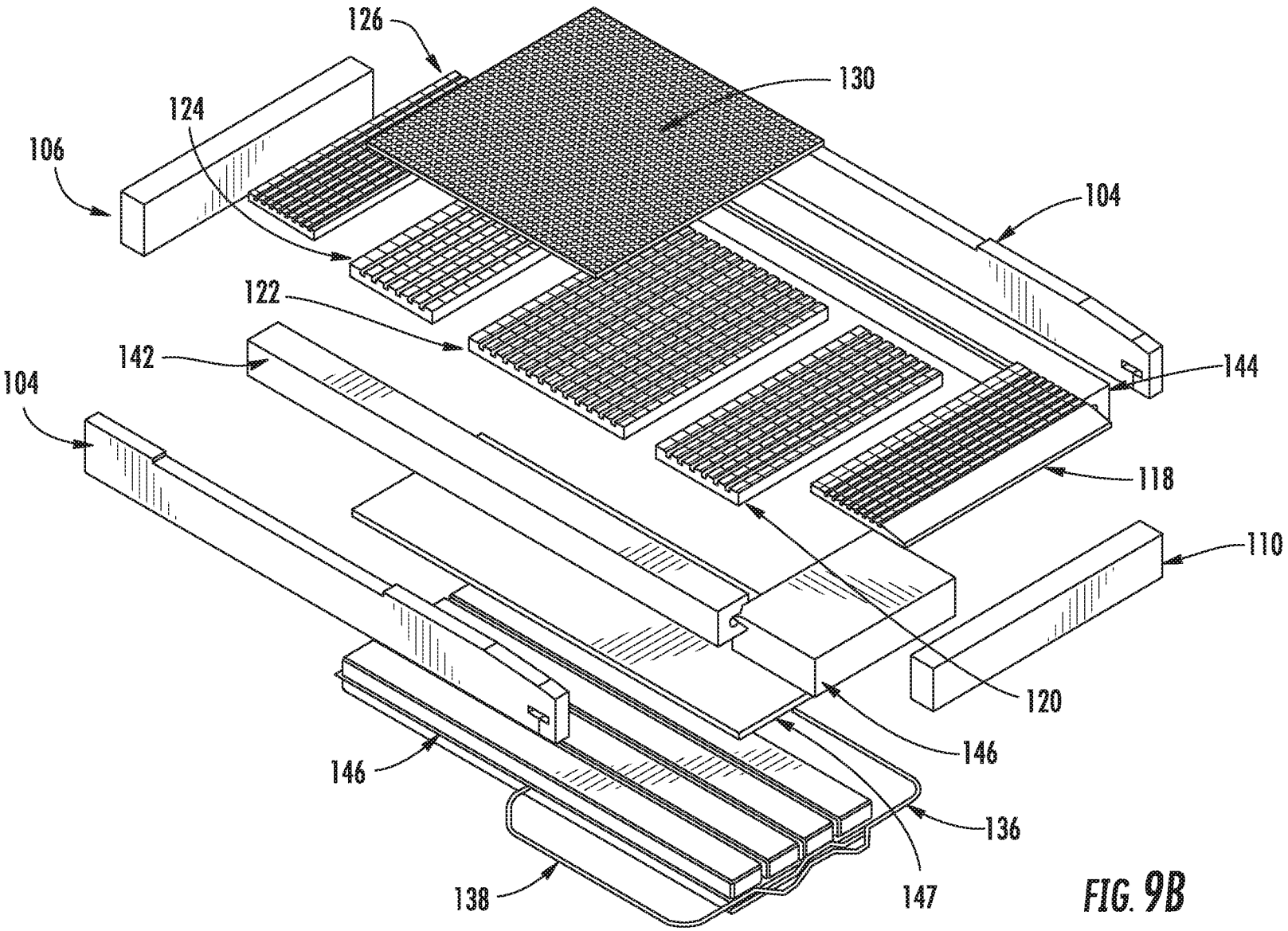
FIG. 9B is a generally side and front perspective view (exploded) of the exemplary patient support surface as represented in present FIG. 9A.

Referring collectively to FIGS. 1, 9A, and 9B, a presently disclosed exemplary air and foam flotation mattress generally 102 has a foam shell portion including foam bolsters/sides 104 running the length of the mattress 102 and on either side thereof. At the respective ends of the air flotation mattress 102 and capping the foam bolsters/sides 104 are, respectively, a foam header 106 adjacent head end 108 and foam footer 110 adjacent foot end 112, which along with the bolsters 104 can form a cavity in the mattress 102. Such cavity when used (not numbered) may be configured in this example for positioning of supports such as air cells 146 therein. As seen from the various present figures, such exemplary selected plurality of air cells 146 in this exemplary embodiment may run from head to foot, received within such cavity. Other configurations, including different pluralities of air cells, and/or orientations and/or locations thereof may be practiced in various embodiments, as understood by those of ordinary skill in the art.

The exploded view of FIG. 9B represents different respective sections or subportions 118, 120, 122, 124, and 126 which may be practiced for specialized support protocols, and may be glued or otherwise joined together to form an upper foam support surface generally 128. For example, such subportions may comprise foams having different support characteristics, or particular support features, such as a grooved surface, as illustrated.

Such figures variously illustrate an additional optional feature, relating to a spacer or three-dimensional fabric portion generally 130 which may be positioned above at least a portion of upper support surface 128. Preferably, as illustrated, such spacer fabric portion may be aligned with areas under a patient's or user's back and buttocks. With air tubing or conduits 132 and 134 interconnecting the spacer fabric to air cylinders, air vis-à-vis the cylinders can be circulated under the patient's relatively high sweating areas of the seating and torso areas. Such air movement (whether being blown out of the mattress or drawn into the mattress) causes heat and moisture of the body to be removed. Different arrangements of tubing or similar devices may be utilized.

As illustrated by such features, tubing generally 136 and 138 may interconnect the ends of air cells 146 for other support purposes, as understood by those of ordinary skill in the art, and which form no particular details of the presently disclosed subject matter. Other internal foam pieces, such as piece 147 may be variously utilized to form the overall support structure with which presently disclosed lateral adjustment of the overall width of the mattress may be practiced.

Thus, in some present exemplary embodiments of the presently disclosed subject matter, an integrated mattress system may be provided for a variety of features, such as circulating air relative to a patient by involving inclusion of a three-dimensional or spacer material in a main patient support structure, or such support structure may have other features, which in each instance makes use of the presently disclosed lateral width adjustment subject matter. All such feature combinations and variations which include such lateral width adjustment subject matter are intended to come within the scope of the presently disclosed subject matter.

Furthermore, in various other embodiments, as referenced above, the presently disclosed subject matter may be integrated with other supports including various mattresses, wheelchair/seating cushions, and/or patient positioners (whether pre-existing, disclosed herewith, or later developed). Several exemplary such support surfaces can be found in commonly owned U.S. Pat. No. 5,568,660 to Raburn et al; U.S. Pat. No. 5,797,155 to Maier et al.; and U.S. Design Patent No. D355,488 to Hargest et al., the disclosures of which are fully incorporated herein by reference, for all purposes.

While the presently disclosed subject matter has been described in detail with respect to specific embodiments thereof, it will be appreciated that those skilled in the art, upon attaining an understanding of the foregoing may readily produce alterations to, variations of, and equivalents to such embodiments. For example, while application FIG. 4 illustrates inflatable/deflatable member (representative tube 148) as interiorly located (between foam bolsters/sides 104 and the central portion of the mattress 102), such member 148 or its equivalent, along with collapsible support features of the presently disclosed subject matter may in some embodiments be located exteriorly (laterally outside the position of foam bolsters/sides 104).

Further, particularly when such foam bolsters/sides 104 are in the most lateral (side) positions relative to mattress 102, they may comprise relatively firm foam, in order to provide a design having a relatively firm perimeter of foam for user or patient support, for minimizing entrapment issues. Patient entrapments, which may result in serious injury or worse, are known types of events in which a patient/resident is caught, trapped, or entangled in the space in or about the bed rail, mattress, or hospital bed frame. Similarly, safety issues may result if there are false side rail latching issues (which occur when a drop side rail is not totally secured in a latched position). Providing an exterior, longitudinal edge as being firm foam in an embodiment configured such as in application FIG. 4, helps to minimize any entrapment or false side rail latching issues. In such context, a firm, edge foam would be one for example having a 25% ILD rating of 50 to 150 lbs., and a density of at least 1.5 lbs./ft3. For some examples, a density range of 1.5 to 5.0 lbs./ft3 is satisfactory. As understood in the art, an ILD rating means "Indentation Load Deflection." For example, a 25% ILD rating would mean the amount of force required (in pounds) to push a 50 sq. in circular surface into a block of foam a total of 25% of the original unloaded thickness of the foam. Similarly, a 75% ILD rating would be the amount of such force in order to deflect a total of 75% of the original unloaded thickness of the foam.

Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. An adjustable width user support, comprising
- a central core support section;
- a pair of side bolsters respectively laterally spaced from said core support section; and
- respective first and second side foam elements, respectively interconnecting said pair of side bolsters with said central core support section, said side foam elements including collapsible structures for lateral adjustment of the overall width of the user support between compressed and expanded positions thereof;
- wherein said collapsible structures comprise a plurality of elongated openings formed in said foam elements for lateral adjustment of the overall width of the mattress between compressed and expanded positions thereof, with at least some of said openings being formed by elongated structures of respective pairs of relatively longer sides and interconnecting respective relatively shorter sides; and
- when said side foam elements are being moved into said compressed position thereof, said relatively longer sides of said elongated structures form stops against each other as they fill the void of their respective opening, and said relatively shorter sides of said elongated structures articulate during collapse to accommodate such relatively longer side movement.

2. An adjustable width user support as in claim 1, wherein said central core support section forms at least part of a patient support mattress.

3. An adjustable width user support as in claim 2, wherein said first and second side foam elements switch uniformly from one density to another when being moved between said expanded and compressed positions thereof.

4. An adjustable width user support as in claim 3, further comprising respective inflatable/deflatable members associated with each of said respective first and second side foam elements, to controllably assist with expansion and compression thereof.

5. An adjustable width user support as in claim 1, wherein said central core support section further includes at least one of different pieces of foam, and combinations of foam and supporting air chambers.

6. An adjustable width user support as in claim 1, wherein said central core support section further includes:
- respective ends which combine with said pair of side bolsters to form a cavity of said user support; and
- a plurality of support foam sections received within said cavity; and
- said user support further includes a waterproof, vapor impermeable, removable cover around said central core support section, said pair of side bolsters, and said side foam elements.

7. An adjustable width user support as in claim 1, wherein:
- said user support comprises one of a therapeutic mattress, a wheelchair support, a seating cushion, a patient positioner, and a consumer mattress; and
- said pair of side bolsters comprise a relatively firm perimeter of foam for user support.

8. An adjustable width patient support system, comprising
- an adjustable bed frame, adjustable between a laterally compressed position and a laterally expanded position thereof;
- an adjustable width mattress having lateral adjustment of the overall width of the mattress between compressed and expanded positions thereof, matching the laterally compressed position and laterally expanded position, respectively, of said adjustable bed frame, said mattress comprising:
  - a central core support section including at least one section of support foam;
  - a pair of foam side bolsters respectively laterally spaced from said central core support section; and
  - respective first and second side foam elements, respectively interconnecting said pair of side bolsters with said central core support section, said side foam elements including collapsible structures comprising a plurality of elongated openings formed in said foam elements for lateral adjustment of the overall width of the mattress between compressed and expanded positions thereof;
- wherein at least some of said elongated openings are formed by elongated structures of respective pairs of relatively longer sides and interconnecting respective relatively shorter sides; and when said mattress is being moved into said compressed position thereof by said adjustable bed frame, said relatively longer sides of said elongated structures form stops against each other as they fill the void of their respective opening, and said relatively shorter sides of said elongated structures articulate during collapse to accommodate such relatively longer side movement.

9. An adjustable width patient support system as in claim 8, wherein said elongated openings comprise octagonally-shaped openings.

10. An adjustable width patient support system as in claim 9, wherein said first and second side foam elements switch uniformly from one density to another, when said mattress is moved between said expanded and compressed positions thereof.

11. An adjustable width patient support system as in claim 10, wherein said patient support system further comprises respective inflatable/deflatable members associated with each of said respective first and second side elements, to controllably assist with expansion and compression thereof.

12. An adjustable width patient support system as in claim 8, wherein said central core support section further includes at least one of different pieces of foam, combinations of foam and supporting air chambers, gel support elements, and mattress padding.

13. An adjustable width patient support system as in claim 8, wherein said central core support section further includes:

respective ends which combine with said pair of foam side bolsters to form a cavity of said mattress; and a plurality of support foam sections received within said mattress cavity.

14. An adjustable width patient support system as in claim 13, wherein:

the orientation and support characteristics of said support foam sections are preselected for predetermined patient support; and said pair of side bolsters comprise a relatively firm perimeter of foam for patient support.

15. An adjustable width patient support system as in claim 8, further comprising:

a waterproof, vapor impermeable, removable cover around said mattress; and wherein said mattress is at least about 4 inches thick, about 80 inches long, and at least about 35 inches wide in at least one position thereof.

16. An adjustable width patient support system as in claim 8, wherein said plurality of elongated openings are formed along the entire length of said foam elements.

17. An adjustable width patient support system as in claim 8, wherein at least some of said elongated openings are partially interrupted by the width of said foam elements, so that at least some only partial elongated openings are present.

18. An adjustable width patient support system as in claim 8, wherein said central core support section further includes a plurality of supporting air chambers, and said system further includes associated air tubing and a controllable air pump, for selectively inflating or deflating said supporting air chambers.

19. An adjustable width patient support system as in claim 8, further including a three-dimensional fabric portion selectively positioned above at least a portion of said central core support section, and associated controllable air flow elements operative with said three-dimensional fabric portion for selectively circulating air in the vicinity of a patient received on said mattress, for removing heat and moisture from such patient.

20. Methodology for providing an adjustable width patient support system, comprising providing a bed frame which is controllably adjustable between a laterally compressed position and a laterally expanded position thereof;

providing on such bed frame an adjustable width mattress having lateral adjustment of the overall width of the mattress between compressed and expanded positions thereof, matching the laterally compressed position and laterally expanded position, respectively, of the adjustable bed frame, such mattress comprising:

a central core support section;

a pair of side bolsters respectively laterally spaced from said central core support section; and respective first and second side foam elements, respectively interconnecting said pair of side bolsters with said central core support section, said side foam elements including collapsible structures comprising a plurality of elongated openings formed in said foam elements, with at least some of said openings being formed by elongated structures of respective pairs of relatively longer sides and interconnecting respective relatively shorter sides, so that when the mattress is being moved into its compressed position by the adjustable bed frame, such relatively longer sides of such elongated structures form stops against each other as they fill the void of their respective opening, and such relatively shorter sides of such elongated structures articulate during collapse to accommodate such relatively longer side movement.

21. Methodology as in claim 20, further including:

providing respective inflatable/deflatable members associated with each of such respective first and second side foam elements; and controllably operating inflation and deflation of such inflatable/deflatable members to assist with expansion and compression.

22. Methodology as in claim 20, further including forming such central core support section with at least one of different pieces of foam, combinations of foam and supporting air chambers, gel support elements, and mattress padding.

23. Methodology as in claim 20, further including:

forming such central core support section with respective ends positioned relative to such pair of side bolsters to form a cavity of such mattress;

providing a plurality of support foam sections within such mattress cavity; and providing said pair of side bolsters as a relatively firm perimeter of foam for patient support.

24. Methodology as in claim 20, further including:

forming such plurality of elongated openings along the entire length of such side foam elements; and providing a waterproof, vapor impermeable, removable cover around such mattress.

* * * * *